US007421761B2

(12) United States Patent
Johnson

(10) Patent No.: US 7,421,761 B2
(45) Date of Patent: Sep. 9, 2008

(54) DOOR CLOSER

(76) Inventor: Loring M. Johnson, 8537 W. Bethany La., Tinley Park, IL (US) 60477

( * ) Notice: Subject to any disclaimer, the term of this patent is extended or adjusted under 35 U.S.C. 154(b) by 52 days.

(21) Appl. No.: 11/534,885

(22) Filed: Sep. 25, 2006

(65) Prior Publication Data

US 2007/0067950 A1 Mar. 29, 2007

Related U.S. Application Data

(63) Continuation of application No. 10/710,739, filed on Jul. 30, 2004, now abandoned.

(51) Int. Cl.
*E05F 3/00* (2006.01)

(52) U.S. Cl. ..... 16/60; 16/59; 16/52; 16/53; 16/58; 16/72; 16/80

(58) Field of Classification Search ..... 16/49, 16/52, 53, 58, 50, 71, 72, 85, DIG. 9, DIG. 17, 16/DIG. 21, 59, 60, 78, 80; 49/339, 348, 49/386, 414, 418, 445
See application file for complete search history.

(56) References Cited

U.S. PATENT DOCUMENTS 3,246,362 A * 4/1966 Jackson ..... 16/51
3,701,180 A * 10/1972 Jentsch et al. ..... 16/55
3,724,023 A * 4/1973 Tillmann ..... 16/53
4,064,589 A * 12/1977 Bejarano et al. ..... 16/53
5,187,835 A * 2/1993 Lee ..... 16/52
5,666,692 A * 9/1997 Toledo ..... 16/80
6,442,795 B1 * 9/2002 Chen ..... 16/53

* cited by examiner

*Primary Examiner*—Robert J Sandy
*Assistant Examiner*—Marcus Menezes
(74) *Attorney, Agent, or Firm*—Michael G. Johnston; Moore & Van Allen PLLC

(57) ABSTRACT

A door closer comprises a spindle journaled in a housing and connected to turn with a door. Upon rotation of the spindle, a cam carried by the spindle effects linear movement of a slide assembly relative to the housing. A piston is connected with the slide assembly. Passages are provided in the housing to permit flow of fluid in the housing in response to movement of the piston. A spring assembly disposed outside of the housing is connected to the piston. Rotation of the spindle and cam during door opening moves the slide assembly, thereby compressing the spring assembly for storing energy for urging the piston and the slide assembly in the opposite door closing direction.

1 Claim, 5 Drawing Sheets

DOOR CLOSER

CROSS-REFERENCES TO RELATED APPLICATIONS

This application is a continuation application of U.S. patent application Ser. No. 10/710,739, filed Jul. 30, 2004, now abandoned the contents of which are incorporated herein by reference.

BACKGROUND

This invention relates generally to a door closer, and more particularly to a door closer for automatically moving a door from an open position to a closed position.

A conventional automatic door closer operates by storing energy in a spring mechanism during opening of a door and releasing the stored energy to close the door. Automatic door closers are provided with means for controlling the movement of the door, usually involving hydraulic resistance within the door closer. When the door approaches a fully open or the closed position, a fluid medium within the door closer is caused to flow through restrictive passages which determine the speed of door movement.

A typical automatic door closer generally comprises an elongated housing which may be mounted above the door, in the transom or lintel, or in the floor. A rotating spindle is disposed adjacent one end of the housing such that an end of the spindle extends from the housing for connecting to the door. The portion of the spindle within the housing is connected for rotation with a cam mechanism. During movement of the door from the closed position to an open position, the cam mechanism acts against at least one adjacent roller fixed to a slide assembly for moving the slide assembly longitudinally in the housing. The slide assembly is connected to a piston in a hydraulic dampening arrangement. The piston divides at least a portion of the interior of the housing into two pressure spaces which are connected to each other by one or more passages for the restricted flow of the fluid medium from one space to the other.

In operation, the spindle and the cam mechanism rotate with the door. When the door moves from the closed position to an open position, the cam mechanism abuts against the roller and moves the slide assembly and the piston from a first position towards one end of the housing. This compresses the spring mechanism and the piston forces fluid to flow from one pressure space to the other. The spring mechanism also provides some resistance to the opening of the door to prevent the door from sudden movement. When the door is released, the stored energy of the compressed spring mechanism supplies energy for closing the door. As the door moves back to the closed position, the extending spring mechanism urges the piston and slide assembly to return to the first position causing the roller to act against the cam for rotating the cam mechanism and spindle and moving the door to the closed position. The speed of closing movement is controlled by the passage of fluid from one pressure space to the other caused by the piston.

A problem with door closers of this type includes the immersion of the operative elements of the door closer in hydraulic fluid. The necessary use of fluid seals and other components lend themselves to possible leakage, which constitutes a safety hazard and can have a damaging effect on the door and floor below.

For the foregoing reasons, there is a need for an automatic door closer which minimizes the number of door closer elements immersed in fluid medium and thereby reduces the problem of preventing possible leakage.

SUMMARY

According to the present invention, a door closer is provided for automatically moving a door in a closing direction. The door closer comprises an elongated housing having a first closed end and an open second end and defining an interior cavity including a cylindrical recess spaced from the first end of the housing. A spindle is journaled in the housing adjacent the first end of the housing for rotation about an axis. At least a portion of the spindle extends from the housing and is adapted to be connected to turn with the door. A cam is carried by the spindle for rotation with the spindle about the axis through an arc in a first direction from a first angular orientation corresponding to the closed position of the door to a second angular orientation corresponding to an open position of the door and about the axis through an arc in an opposite direction from the second angular orientation to the first angular orientation. Rotation of the cam from the first angular orientation to the second angular orientation corresponds to movement of the door in the opening direction and rotation of the cam from the second angular orientation to the first angular orientation corresponds to movement of the door in the closing direction. A slide assembly includes a cam following roller for cooperating with the cam for converting rotation of the cam into linear movement of the slide assembly relative to the housing. A piston is slidably disposed in the cylindrical recess and a piston rod is connected at one end to the piston and at the other end to the slide assembly. Spring means disposed outside of the housing urge the piston and slide assembly in the door closing direction. The spring means includes a spring rod connected at one end to the second end of the piston. First and second annular plugs are disposed in the housing adjacent the ends of the cylindrical recess for slidably sealingly receiving the piston rod and the spring rod, respectively. The first and second annular plugs and piston divide the cylindrical recess into a first chamber between the first annular plug and the end of the piston and a second chamber between the second annular plug and the other end of the piston. Passage means defined in the housing permit flow of fluid between the cylindrical recess and the cavity between the first annular plug and the closed end of the housing in response to movement of the piston. Upon rotation of the spindle and cam in the door opening direction, the cam operates against the cam following roller for moving the slide assembly toward the first closed end of the housing and the piston toward the first end of the cylindrical recess thereby compressing the spring means for storing energy. The spring means urges the piston toward the second end of the cylindrical recess for moving the slide assembly toward the second end of the housing and the cam following roller against the cam to rotate the cam and the spindle in the door closing direction.

BRIEF DESCRIPTION OF THE DRAWINGS

For a more complete understanding of the present invention, reference should now be had to the embodiments shown in the accompanying drawings and described below. In the drawings.

DESCRIPTION

Figure 1:
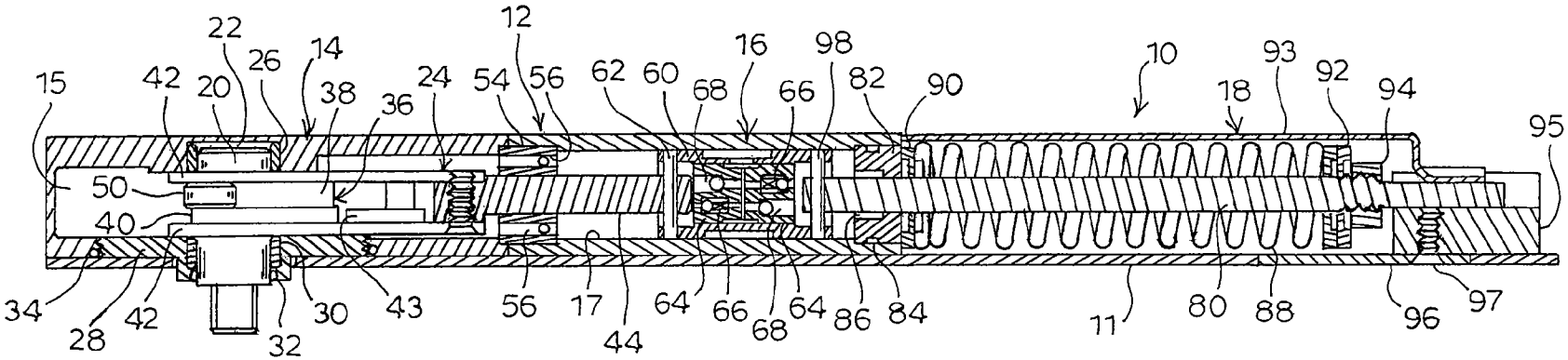
FIG. 1 is a side elevation view of an embodiment of a door closer according to the present invention showing a longitudinal cross section of the housing, damping portion and spring assembly.

Certain terminology is used herein for convenience only and is not to be taken as a limitation on the invention. For example, words such as "upper," "lower," "left," "right," "horizontal," "vertical, " "upward," and "downward" merely describe the configuration shown in the FIGs. Indeed, the components of the door closer may be oriented in any direction and the terminology, therefore, should be understood as encompassing such variations unless specified otherwise.

As used herein, the term "open position" for a door means a door position other than a closed position, including any position between the closed position and a fully open position as limited only by structure around the door frame, which can be up to 180° from the closed position.

Referring now to the drawings, wherein like reference numerals designate corresponding or similar elements throughout the several views, a door closer according to the present invention is shown in FIGS. 1-4 and generally designated at 10. The door closer 10 comprises a housing 12 and a spring assembly 18. The housing includes a mechanical end portion 14 and a dampening end portion 16.

The mechanical end portion 14 defines an interior cavity 15 and has openings into the cavity 15 in a major face and at one end of the mechanical end portion 14. The cavity 15 in the mechanical end portion 14 accommodates a spindle 20, a cam assembly 22, and a slide assembly 24. The spindle 20 is rotatably mounted in the cavity 15 and extends normal to the longitudinal axis of the housing 12. An inner cylindrical end of the shaft of the spindle 20 is supported in an annular bore in the housing 12 by an inner roller bearing 26. The opening in the major surface of the mechanical end portion 14 is internally threaded for receiving an externally threaded spindle cap 28. The spindle 20 has an intermediate cylindrical shaft portion journaled in an outer roller bearing 30 held within a rim in the spindle cap 28 for rotatably supporting the spindle 20. The outer end of the shaft of the spindle 20 extends through an opening in the spindle cap 28 outwardly of the housing 12. The spindle 20 and spindle cap 28 are sealed by o-rings 32, 34 which prevent leakage of a hydraulic working fluid from the interior cavity 15 of the housing 12.

Figure 3:
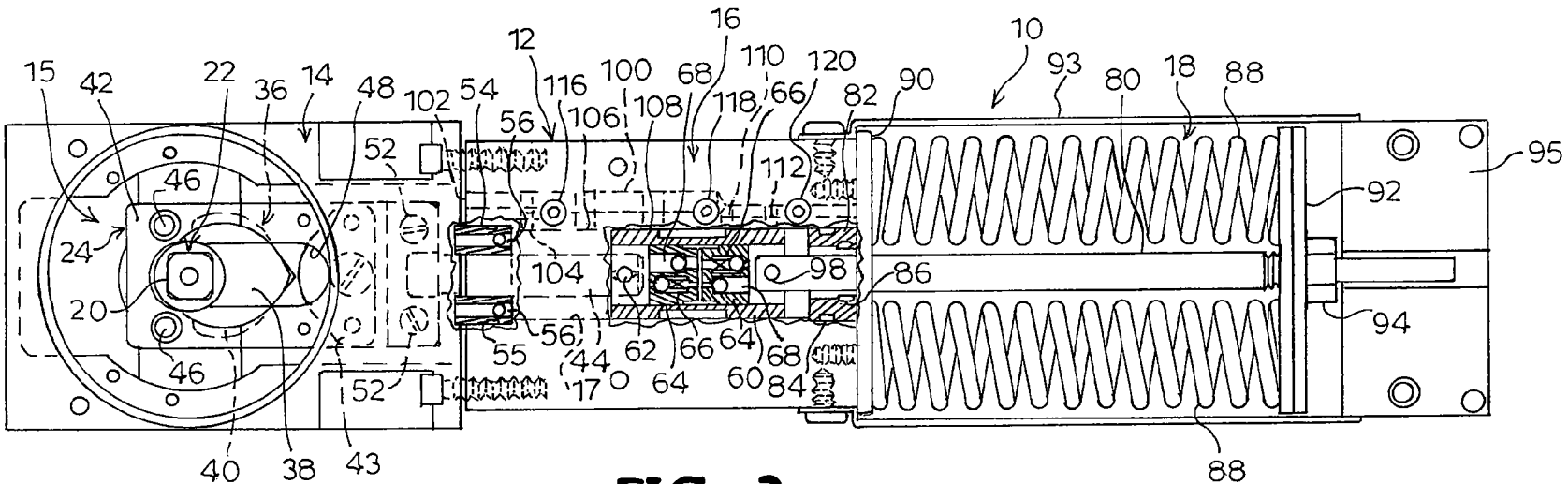
FIG. 3 is a bottom plan view of the door closer as shown in FIG. 2 with the spindle cap removed and showing a longitudinal cross section of a portion of the damping portion of the housing.
Figure 4:
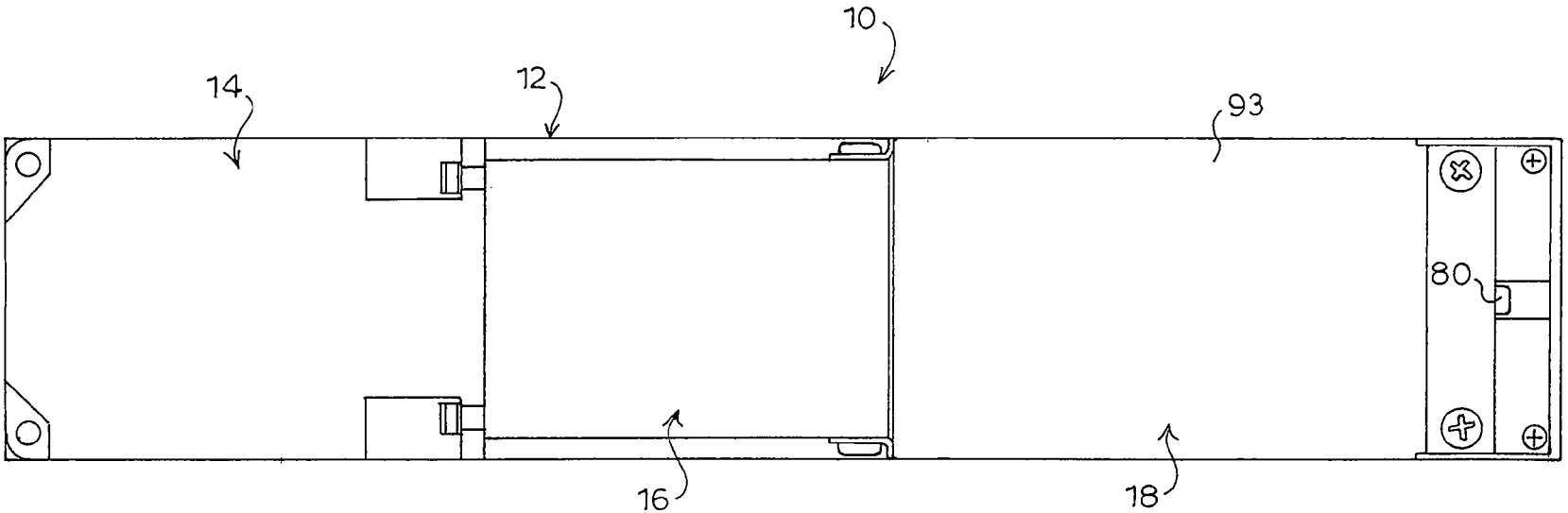
FIG. 4 is a top plan view of the door closer shown in FIG. 1.

The cam assembly 22 comprises an eccentric cam 36. The cam 36 includes a first cam plate 38 and a second cam plate 40 mounted together in fixed spaced relation to the spindle 20 for rotation with the spindle 20. Each of the cam plates 38, 40 has a peripheral camming surface. As best seen in FIG. 3, the cam 36 is a double-acting butterfly type cam, which is symmetrical about its centerline.

Referring to FIG. 1, the slide assembly 26 comprises upper and lower draw bar plates 42, a draw bar rod 44, and a cam follower 43. The draw bar plates 42 are connected to each other in spaced parallel relation above and below the cam 36 by a pair of vertical trunions 46 (FIG. 3), the ends of which are located in corresponding bores in the draw bar plates 42. Each of the trunions 46 mounts rollers 50 (FIG. 1) between the draw bar plates 42. The rollers 50 are positioned diametrically opposite each other with reference to the axis of rotation of the spindle 20. The rollers 50 act as a cam followers which engage and track the peripheral surface of the cam 36 during rotation of the spindle 20 and cam 36. The draw bar plates 42 have opposed elongated guide slots 48 (FIG. 3) through which the spindle 20 extends. As will be described more fully below, the slide assembly 24 is reciprocal in the housing 12 in response to rotation of the spindle 20 and cam 36 and is guided for longitudinal movement by the spindle 20 moving in the slots 48 in the draw bar plates 42.

As seen in FIG. 3, the draw bar rod 44 is T-shaped. The head portion of the "T" has openings at each end for receiving threaded fasteners 52 for securing the draw bar rod 44 to the end of the draw bar plates 42 opposite the cam 36. The distal end of the draw bar rod 44 extends into the dampening end portion 16 of the housing 12.

The dampening end portion 16 of the housing 12 is secured to the mechanical end portion 14 using threaded fasteners received in axial threaded openings in the corners of the dampening end portion 16 (FIG. 3). The dampening end portion 16 of the housing 12 defines an interior axial cylinder 17 which is open at both ends. An annular back check disc 54 is sealingly secured in the end of the cylinder 17 adjacent the mechanical end portion 14 of the housing 12. The back check disc 54 is fixed with respect to the cylinder 17 and is sealed to the walls of the dampening end portion 16 with an o-ring 55 disposed in a circumferential groove. The back check disc 54 thus effectively separates the portion of the cavity 15 in the mechanical end portion 14 of the housing 12 from the cylinder 17 in the dampening end portion 16. The back check disc 54 slidingly receives the draw bar rod 44 which extends into the cylinder 17. The back check disc 54 includes a plurality of ball check valves 56 which allow one-way fluid flow from the cavity 15 in the mechanical end portion 14 into the cylinder 17.

A hollow spool-shaped piston 60 is slidably disposed within the cylinder 17 for reciprocal movement relative to the housing 12. The annular ends of the piston 60 seal against the wall of the dampening end portion 16 defining the cylinder 17 to establish a fluid tight relation between the ends of the piston 60 and the housing 12. One end of the piston 60 is connected to the draw bar rod 44 by means of a pin 62.

A pressure relief valve 64 is disposed in each end of the piston 60. Each pressure relief valve 64 has two axial valves 66, 68. One set of valves 66 includes a ball and a spring combination disposed in an inner larger diameter portion of the one set of passages. The diameter of the balls are larger than a smaller outer diameter portion of the passages. The springs bias the balls against the smaller diameter passage such that the passages are normally closed. The other set of valves 68 is one-way ball check valves which prevent the flow of fluid in a direction into the piston 60. As seen in FIG. 1, there is a slight gap between the inner ends of the pressure relief valves 64. A radial passage in the smaller diameter middle portion of the piston 60 allows fluid to enter into the gap and flow out of the ends of the piston 60 through the ball check valves 68 of the pressure relief valves 64. Fluid cannot normally flow into the ends of the piston 60. However, excessive fluid pressure at the ends of the cylinder 17 will cause the balls to unseat allowing fluid to pass to relieve pressure.

An annular check disc 82 is sealingly secured in the distal end of the cylinder 17 of the dampening end portion 16 adjacent the spring assembly 18. The check disc 82 is fixed with respect to the cylinder 17 and is sealed to the walls of the dampening end portion 16 with an o-ring 84 disposed in a circumferential groove on the periphery of the check disc 82. The check disc 82 thus effectively seals the distal end of the dampening end portion 16 of the housing 12. As shown in the FIGS. 1 and 3, in this arrangement, the piston 60 divides the cylinder 17 in the dampening end portion 16 into a first variable volume chamber between one end of the piston 60 and the back check disc 54 and a second variable volume chamber between the other end of the piston 60 and the check disc 82.

The spring assembly 18 comprises a spring rod 80 and coil compression springs 88 supported between a spring bar 90 and a spring retainer plate 92. The spring bar 90 is secured to the damping end portion 16 of the housing 12 using threaded fasteners received in axial threaded openings in the dampening end portion 16 adjacent the check disc 82 (FIG. 3). The spring rod 80 passes through openings in the spring bar 90 and the spring retainer plate 92. The spring retainer plate 92 is held on the threaded end of the spring rod 80 with an adjusting nut 94. The spring rod 80 is slidingly received by the check disc 82 and extends into the cylinder 17 where the end of the spring rod 80 is connected to the end of the piston 60 by means of a pin 98. The spring assembly 18 the urges the piston 60 towards the right end portion of the cylinder 17, as seen in the FIGs. An o-ring 86 surrounds the spring rod 80 for sealing the cylinder 17 against leakage of fluid. A channel-shaped spring cover 93 secured to the dampening end portion 16 of the housing 12 surrounds the spring assembly 18. A spring block 95 is secured to the distal end of the spring cover. The adjusting nut 94 is accessible by tool from the bottom end of the housing 12 when a small cover 96 (FIG. 2) is removed. Rotating the adjusting nut 94 sets the initial compressed length of the springs 88.

Figure 5:
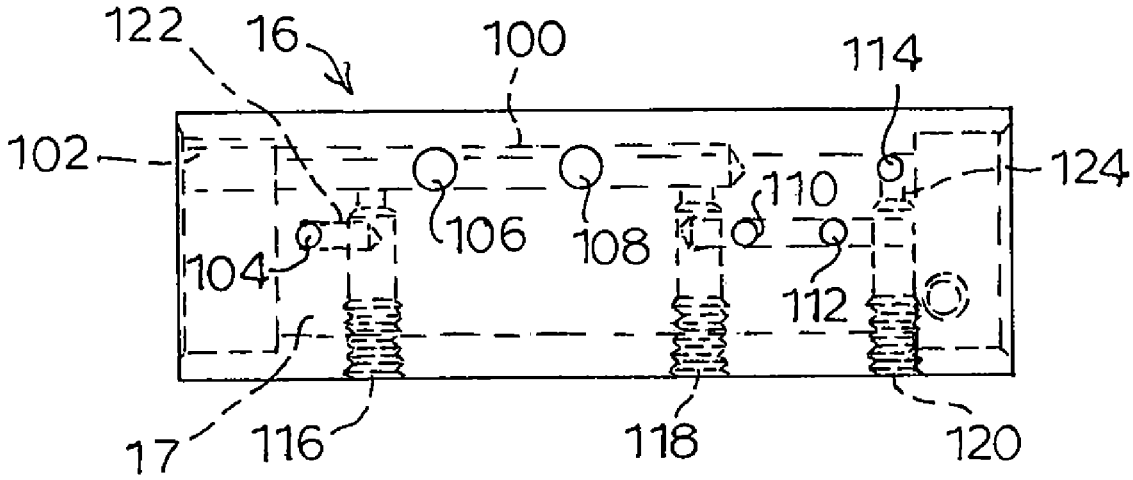
FIG. 5 is a side elevation view of the damping portion of the door closer shown in FIG. 1 with an internal cylinder and fluid passages shown in phantom.

A fluid medium, such as hydraulic oil, is provided in the cavity 15 in the housing 12 to cooperate with the piston 60, and the dampening end portion 16 of the housing 12 is provided with passages though which fluid is transferred from one side of the piston 60 to the other during reciprocal movement of the piston 60 in the cylinder for regulating movement of the door. Referring to FIGS. 3 and 5, a main fluid passage 100 runs longitudinally from the distal end of the damping portion 16 to an opening 102 into the cavity in the mechanical end portion 14 of the housing 12 and thus serves as a conduit for fluid to pass between the damping portion 16 and the mechanical end portion 14 of the housing 12. Six longitudinally spaced radial passages 104, 106, 108, 110, 112, 114 extend from ports that open into the cylinder and to the main fluid passage 100.

Figure 2:
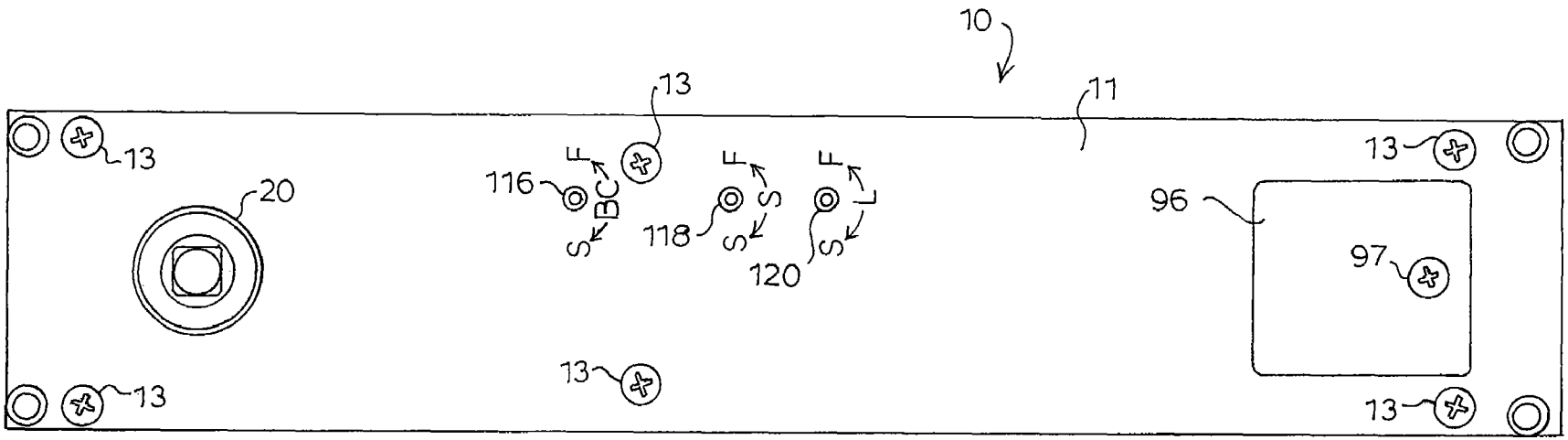
FIG. 2 is a bottom plan view of the door closer as shown in FIG. 1.

Three throttle devices 116, 118, 120 comprising needle valves in threaded bores are longitudinally arranged along the main fluid passage 100. The threaded bores are in fluid communication with the main fluid passage 100. As seen in FIG. 2, a portion of the throttle devices 116, 118, 120, including a regulating screw, are exposed through the bottom cover 11 of the housing 12. A tool can be applied to the screw to adjust the axial position of the needle valve in the respective bore for selectively establishing the degree of constriction of the flow path past the needle valve for regulating the flow of fluid. This arrangement allows the movement speed of the door to be controlled based on the axial positioning of the needle valves, particularly at the extremes of the closed position and fully open positions of the door. In particular, a back check valve 116 controls resistance near the fully opened door position, a stroke valve 118 controls the speed of the door in moving from an open position to near the closed position, and a latch valve 120 controls the movement of the door as the door reaches the closed position. For convenience, the valves 116, 118, 120 are identified with the letters "BC", "S" and "L" on the bottom cover 11 of the housing 12.

In keeping with the present invention, the door closer 10 is mounted in the door frame above the door, preferably in a concealed position in the header, or overhead portion of the frame. The end portion of the spindle 20 is noncircular and extends from the housing 12 for being received in a complementary recess in the upper end of the door so that the door and spindle 20 turn together. The door is supported in the door frame for pivoting about the axis of rotation of the spindle 20 for movement between the closed position and an open position. In this arrangement, movement of the door causes the spindle 20 to turn in one direction and subsequent moving from an open position to the closed position causes the spindle 20 to turn in the opposite direction.

In operation, the components of the door closer 10 according to the present invention are as shown in FIGS. 1 and 3 when the door is in the fully closed position. As the door is opened, the door rotates the spindle 20. The cam 36 is rotated between the draw bar plates 42 with the spindle 20. It is understood that the door closer 10 can be used on a left hand door or a right hand door and, therefore, the door could be opened in a either a clockwise or a counterclockwise direction, as viewed in FIGS. 1 and 3. Depending on which direction the door opens, one or the other of the opposed camming surfaces on the cam 36 bears against the adjacent follower roller 50 which causes the slide assembly 24 to move linearly to the left as seen in FIGS. 1 and 3. Because the draw bar rod 44 is connected to the piston 60, the piston is also moved toward the left end of the cylinder 17. Movement of the piston 60, in turn, carries the spring rod 80 to the left, thereby compressing the springs 88 between the spring bar 90 and the spring retaining plate 92.

As the piston 60 moves toward the left end of the cylinder 17, the fluid inside the left end of the cylinder flows primarily through the two large diameter radial passages 106, 108 between the back check valve 116 and the stroke valve 118 and into the main fluid passage 100. The fluid passes through the opening 102 into the cavity 15 in the mechanical end portion 14 of the housing 12. Some of the fluid will also flow through the rightmost radial passage 108, into the piston 60 between the pressure relief valves 64, and out the end of the piston 60 through the ball check valve 68 thus filling the right end of the cylinder 17. As described above, if the pressure in the fluid flow path becomes excessive, the pressure may force the ball in the valve 66 in the leading end of the piston 60 to retract into the larger diameter portion of the passage so as to open the passage allowing fluid flow through the piston 60 with relatively little hydraulic resistance.

As the door continues to open and the piston 60 moves further to the left in the cylinder 17, the piston 60 gradually closes off the two passages 106, 108. This occurs at a certain opening angle of the door, for example, at about 70 degrees. Fluid can now flow out of the cylinder 17 only from the leftmost passage 104. Fluid entering this passage 104 is directed through a passage 122 to the back check valve 116 and out to the main fluid passage 100. As described above, the back check valve 116 regulates the flow of fluid leaving the cylinder 17. Therefore, resistance to door opening begins as the fluid becomes a damper to hinder the movement of the piston 60 which slows down rotation of the spindle 60 and the door. When the door reaches a fully open position, the piston 60 is adjacent the left end of the cylinder 17 and the springs 88 are compressed.

It is understood that the cam 36 is easily adapted for either 90-degree or 105-degree door swing. The cam 36 may be provided with opposed radius notches (not shown) which can be entered by a roller 50 when the door reaches an open position. The roller 50 drops into the notch where the resistance is enough to overcome the closing force of the spring assembly 18 for maintaining the door in an open position. If the door is held open, the door is easily closed by swinging it manually to clear the roller 50 out of the notch whereupon the energy stored in the springs 88 during opening of the door is released to move the door to the closed position.

Movement of the door from an open position to the closed position is effected by expansion of the spring assembly 18 acting to move the piston 60 and the slide assembly 24 to the right as seen in FIGS. 1 and 3. The engaged roller 50 bears against the camming surface of the cam 36 causing the cam 36 and the spindle 20 to rotate for moving the door toward the closed position. The cam follower 43 bears against the camming surface on the opposite side of the cam 36 for controlling the movement of the door in the closing direction.

During the first portion of the closing movement of the door, the piston 60 forces the fluid in the right end of the cylinder 17 through the two passages 110, 112 between the stroke check valve 118 and the latch check valve 120. The speed of movement of the closing door will be regulated by the flow of fluid past the stroke valve 118. As the door continues to move toward the closed position, the leading end of the piston closes off these fluid passages 110, 112. Typically this occurs as the door nearly reaches the closed position, for example, from about 5 degrees to about 7 degrees from the closed position. The only available passage for fluid to exit the cylinder 17 is the passage 114 at the same axial location as the latch check valve 120 (FIG. 5). The speed of the door thus slows and resistance to door closing builds as the fluid becomes a damper to hinder the movement of the piston 60. Fluid entering this rightmost passage 114 is directed through a passage 124 and to the latch check valve 120. The latch check valve 120 operates to regulate the flow of fluid exiting the cylinder 17.

The back check disc 54 also cooperates during door closing to permit fluid in the mechanical end portion 14 of the housing 12 to flow into the cylinder between the piston 60 and the back check disc 54. This occurs because the fluid pressure is on the opposite side of the piston 60 thereby freeing the balls from the passages in the ball check valves 56 in the back check disc 54 allowing fluid to pass. It is understood that during door opening the flow of fluid from the cylinder to the cavity in the mechanical end portion 14 is prevented by the one-way check valves 56. Accordingly all of the fluid expelled from the cylinder must flow through the main fluid passage 100.

When the door reaches the closed position, the components of the door closer 10 are again as shown in FIGS. 1 and 3.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, some of the novel features of the present invention could be used with any type of automatic door closer. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a crew may be equivalent structures.

The invention claimed is:

1. A door closer for automatically moving a door in a closing direction, the door positioned within a door frame and hinged along one edge to the door frame for movement between a closed position and an open position, the door closer comprising:

a housing having a first closed end and an open second end and defining an interior cavity including a cylindrical recess spaced from the first end of the housing;

a spindle journaled in the housing adjacent the first end of the housing for rotation about an axis, at least a portion of the spindle extending from the housing and adapted to be connected to turn with the door;

a cam carried by the spindle for rotation with the spindle about the axis through an arc in a first direction from a first angular orientation corresponding to the closed position of the door to a second angular orientation corresponding to an open position of the door and about the axis through an arc in an opposite direction from the second angular orientation to the first angular orientation, wherein rotation of the cam from the first angular orientation to the second angular orientation corresponds to movement of the door in the opening direction and rotation of the cam from the second angular orientation to the first angular orientation corresponds to movement of the door in the closing direction;

a slide assembly including a cam following roller for cooperating with the cam for converting rotation of the cam into linear movement of the slide assembly relative to the housing;

a piston having a first end and a second end, the piston slidably disposed in the cylindrical recess;

a piston rod connected at one end to the first end of the piston and at the other end to the slide assembly;

spring means disposed outside of the housing for urging the piston, the slide assembly and the cam in the door closing direction, the spring means including a spring rod connected at one end to the second end of the piston;

first and second annular check disc plugs disposed in the housing adjacent first and second ends of the cylindrical recess for slidably sealingly receiving the piston rod and the spring rod, respectively, the first and second annular plugs and piston dividing the cylindrical recess into a first chamber between the first annular plug and the first end of the piston and a second chamber between the second annular plug and the second end of the piston;

passage means defined in the housing for permitting flow of fluid between the cylindrical recess and the space of the cavity defined between the first annular plug and the closed end of the housing in response to reciprocation of the piston in the cylindrical recess, wherein upon rotation of the spindle and cam in the door opening direction the cam operates against the cam following roller for moving the slide assembly toward the first end of the housing and the piston toward the first end of the cylindrical recess and compressing the spring means for storing energy, the spring means urging the piston toward the second end of the cylindrical recess for moving the slide assembly toward the second end of the housing and the cam following roller against the cam to rotate the cam and the spindle in the door closing direction.

* * * * *